US006703776B1

(12) United States Patent
Van Der Vaart et al.

(10) Patent No.: US 6,703,776 B1
(45) Date of Patent: Mar. 9, 2004

(54) CATHODE RAY TUBE

(75) Inventors: Nijs Cornelis Van Der Vaart, Eindhoven (NL); Gerardus Gegorius Petrus Van Gorkom, Eindhoven (NL); Petrus Hubertus Franciscus Trompenaars, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 169 days.

(21) Appl. No.: 09/671,986

(22) Filed: Sep. 28, 2000

(30) Foreign Application Priority Data

Oct. 1, 1999 (EP) ..... 99203223

(51) Int. Cl.[7] ..... H01J 29/46
(52) U.S. Cl. ..... 313/446; 313/452; 313/441
(58) Field of Search ..... 313/414, 412, 313/421, 426, 427, 103 R, 477 R, 422, 452, 453, 454, 455, 446

(56) References Cited

U.S. PATENT DOCUMENTS 4,940,917 A * 7/1990 Stil ..... 313/414
5,015,911 A * 5/1991 Cho ..... 313/414
5,270,611 A 12/1993 Van Gorkom ..... 313/422

* cited by examiner

*Primary Examiner*—Vip Patel
*Assistant Examiner*—Sharlene Leurig

(57) ABSTRACT

A cathode ray tube comprising an electron source and an electron beam guidance cavity having an input aperture and an output aperture, wherein at least a part of the wall of the electron beam guidance cavity near the output aperture comprises an insulating material having a secondary emission coefficient δ1 for cooperation with the cathode. Furthermore, the cathode ray tube comprises a first electrode which is connectable to a first power supply for applying, in operation, an electric field with a first field strength E1 between the cathode and the output aperture. δ1 and E1 have values which allow electron transport through the electron beam guidance cavity. The cathode ray tube further comprises a conventional main lens to obtain a spot on a display screen. According to the invention, an electron lens is placed between the exit of the cavity and the main lens for directing the electron beam at a predetermined angle towards the entrance of the main lens.

45 Claims, 3 Drawing Sheets

CATHODE RAY TUBE

BACKGROUND OF THE INVENTION

1. Field of the Invention

The invention relates to a cathode ray tube having (1) an electron source having a cathode for emission of electrons, (2) an electron beam guidance cavity having an input and an output for concentrating electrons emitted from the cathode, (3) a first electrode being connectable to a first power supply for applying, in operation, an electric field with a first field strength E I between the cathode and the output of the cavity so as to allow electron transport through the electron beam guidance cavity, and (4) an accelerating grid for accelerating the electrons leaving the cavity and a main electron lens for focusing the accelerated electrons on a display screen.

Such a cathode ray tube may be used in television displays, computer monitors and projection TVs.

2. Description of the Related Art

A cathode ray tube of the type described in the opening paragraph is known from U.S. Pat. No. 5,270,611. This patent describes a cathode ray tube that is provided with the cathode, the electron beam guidance cavity and the first electrode which is connectable to a first power supply for applying the electric field with a first field strength E1 between the cathode and the output aperture. The electron beam guidance cavity has walls in which, for example, a part of the wall near the output has an insulating material having a secondary emission coefficient δ1. Furthermore, the secondary emission coefficient δ1 and the first field strength E1 have values that allow electron transport through the electron beam guidance cavity. The electron transport within the cavity is possible when a sufficiently strong electric field is applied in a longitudinal direction of the electron beam guidance cavity. The value of this field depends on the type of material and on the geometry and sizes of the walls of the cavity. The electron transport then takes place via a secondary emission process so that, for each electron impinging on a cavity wall, one electron is emitted on average. The circumstances can be chosen to be such that as many electrons enter the input aperture of the electron beam guidance cavity as will leave the output aperture. When the output aperture is much smaller than the input aperture, an electron compressor is formed which concentrates the luminosity of the electron source by a factor of, for example, 100 to 1000. An electron source with a high current density can thus be made. The accelerating grid accelerates electrons leaving the cavity towards the main electron lens. The main electron lens images the exit hole of the cavity on the display screen and, via a deflection unit, a raster image is formed on the display screen of the tube.

The spot size of the electron beam determines the resolution of the tube. Especially for computer monitor tubes and also television picture tubes, the resolution may be an important feature.

SUMMARY OF THE INVENTION

It is, inter alia, an object of the invention to provide a cathode ray tube in which the spot size of the electron beam on the display screen is reduced. This object is achieved by the cathode ray tube according to the invention, which is characterized in that the cathode ray tube comprises a further electron lens between the cavity and the main lens for adapting the diameter of the electron beam to the entrance of the main lens, said further electron lens comprising the first electrode and the accelerating grid. The electron beam entering the main lens is then less divergent and the spherical aberrations caused by the main lens are reduced. The invention is based on the recognition that the electrons leaving the electron beam cavity have a relatively high velocity compared to electrons leaving a conventional cathode, and therefore the diameter of the electron beam entering the main lens is too large. With the prefocussing effect of the further electron lens between the electron beam cavity and the main lens, and given a fixed relationship of the distances between the cathode, main lens and display screen, the diameter of the electron beam entering the main lens can be optimized for a small spot size and minimal spherical aberrations.

Further advantageous embodiments of the invention are defined in the dependent claims.

A particular version of the cathode ray tube according to the invention is characterized in that the first electrode comprises a first and a second part, placed behind each other along an axis of the main lens, the diameter of the first part being smaller than the diameter of the second part. A so-called cup lens is then formed for prefocussing the electron beam before entrance into the main lens. An advantage of the cup lens is its economic design. Moreover, the cup-lens is robust against flashes which occur during the manufacturing process of the cathode ray tube or during operation. The first and second parts may have different symmetric shapes. The shape of the parts can also be adapted in order to reduce astigmatism of the spot on the display screen, for example, the shape of the cup lens may be a rectangle or ellipsoid.

A further version of the cathode ray tube according to the invention is characterized in that the further electron lens further comprises a second electrode which is concentric with the first electrode, the second electrode being connectable to a second power supply for applying, in operation, an electric field with a second field strength E2 between the first and the second electrodes, the voltage of the second power supply being lower than that of the first power supply. An electron lens is then formed having a special shape for prefocusing the electron beam in the entrance of the main lens. An advantage of this electron lens is that some of the electron lens characteristics can be adjusted when the cathode is mounted in the cathode ray tube. This is in contrast with the above-mentioned cup lens, which has characteristics that are completely determined when the cathode is mounted in the cathode ray tube. Furthermore, the first and second electrodes may have a symmetrical shape.

A further version of the cathode ray tube according to the invention is characterized in that the first and second electrodes are substantially in the same plane. A planar electron lens is thus obtained. These planar lenses can be easily made by removing parts of metal forming the first electrode. Furthermore, a planar lens design allows a large degree of freedom in the prefocussing characteristics of the electron lens.

A further version of the cathode ray tube according to the invention is characterized in that the cathode ray tube comprises a third electrode placed between the cathode and the cavity, said third electrode being connectable to a third power supply for applying, in operation, an electric field with a third field strength E3 between the cathode and the third electrode for controlling the emission of electrons. In this way, relatively small modulation voltages can be applied for modulating the electron beam. For example, when the distance between the cathode and the third electrode amounts to 100 micrometers, an amplitude modulation of 5 Volts is sufficient for modulating a current between 0 and 3 mA when conventional oxide cathodes are used. This modulation gauze is described in the unpublished EP patent application 9920199.6.

BRIEF DESCRIPTION OF THE DRAWINGS

These and other aspects of the invention are apparent from and will be elucidated with reference to the embodiments described hereinafter.

In the drawing.

DETAILED DESCRIPTION OF THE PREFERRED EMBODIMENTS

Figure 1:
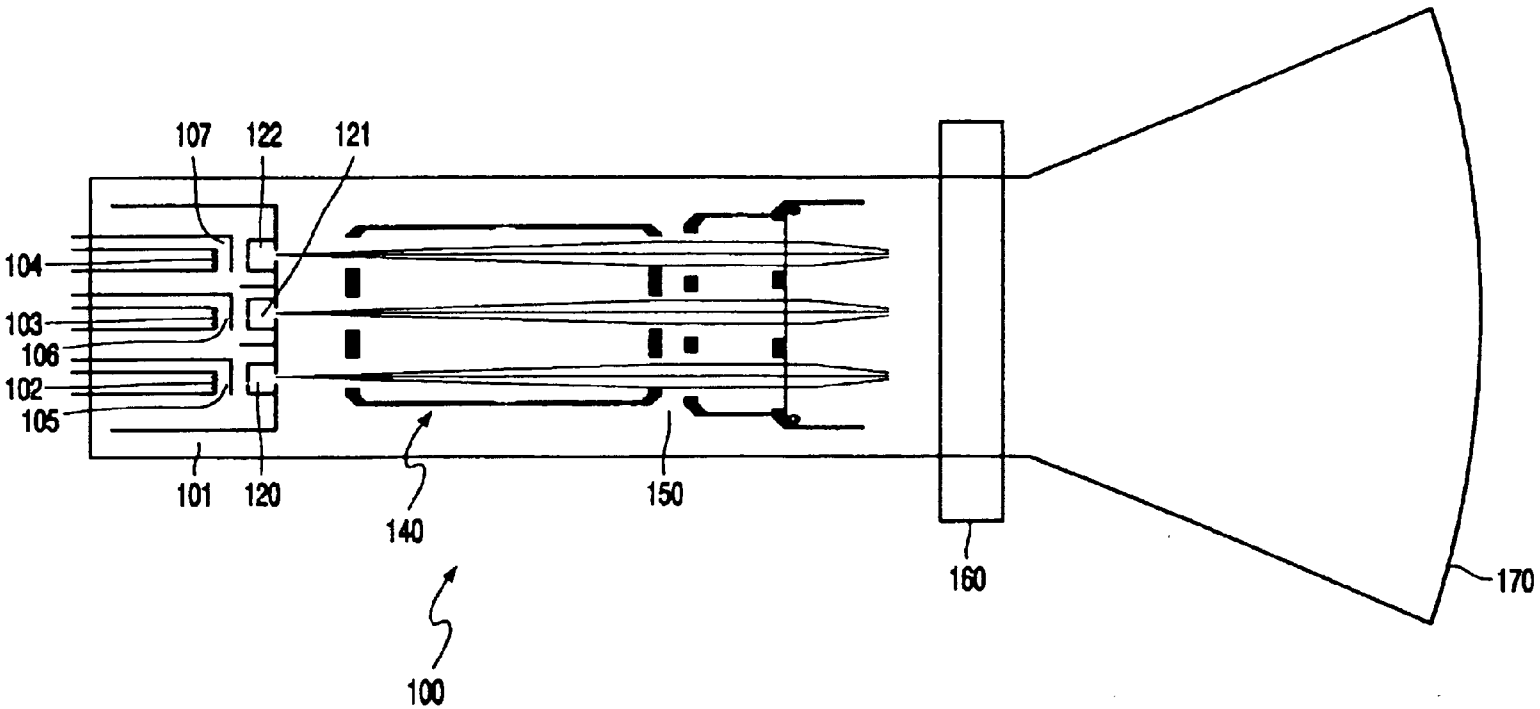
FIG. 1 PRIOR ART
FIG. 1 is a schematic diagram of a cathode ray tube.

FIG. 1 is a schematic diagram of a known cathode ray tube. This cathode ray tube is known from the cited U.S. Pat. No. 5,270,611. The cathode ray tube 100 comprises an electrode structure 101 having cathodes 105,106,107 for emission of electrons, and electron beam guidance cavities 120,121,122. Preferably, the cathode ray tube comprises heating filaments 102,103,104. Furthermore, the cathode ray tube comprises an accelerating grid 140, a conventional main lens 150 and a conventional magnetic deflection unit 160 and a display screen, for example a conventional color phosphor screen 170. All these parts are known from conventional color cathode ray tubes. The cathode ray tube according to the invention may be applied in television, projection television and computer monitors.

Figure 2:
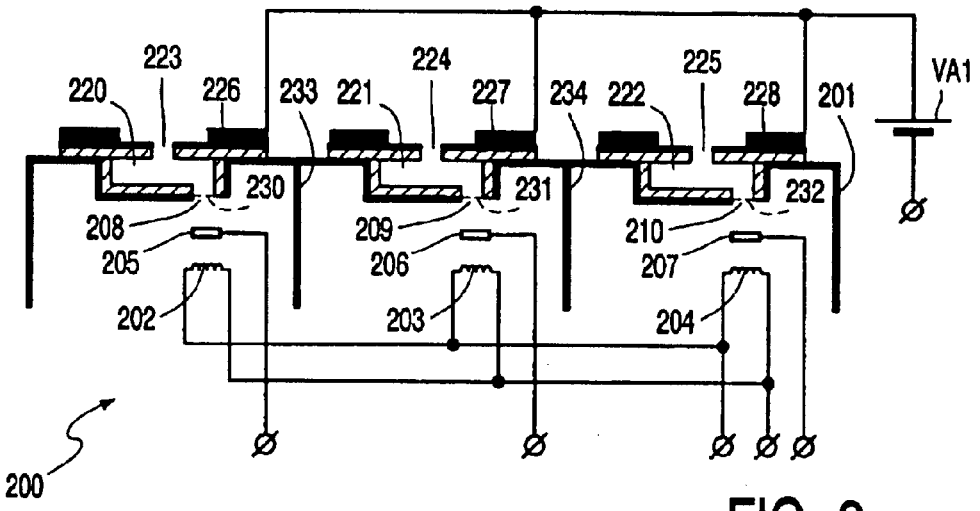
FIG. 2 shows a first embodiment of a cathode structure with a cup lens according to the invention for use in a cathode ray tube.

FIG. 2 shows a first embodiment of the cathode structure in accordance with the invention, which cathode structure may be applied in the cathode ray tube shown in FIG. 1 The cathode structure 200 comprises a frame 201, heating filaments 202, 203, 204 and cathodes 205,206,207 corresponding to each of the heating filaments. The cathodes are provided in triplicate so that the cathode ray tube may be used for the display of color images represented by red, green and blue signals. Furthermore, the cathode structure 200 comprises electron beam guidance cavities 220,221,222 each having input apertures 208,209,210, output apertures 223,224,225 and first electrodes 226,227,228. The input apertures 208,209,210 may have a square shape with dimensions of 2.5×2.5 mm. At least a part of the interior around the output apertures 223,224,225 of the electron beam guidance cavities 220,221,222 is covered with an insulating material having a secondary emission coefficient $\delta 1>1$ for cooperation with the cathodes 205,206,207. This material comprises, for example, MgO. The MgO layer has a thickness of, for example, 0.5 micrometer. Other materials that may be used are, for example, glass or Kapton polyamide material. The first electrodes 226,227,228 are positioned around the output apertures 223,224,225 on the outer side of the electron beam guidance cavities 220,221,222. The first electrodes consist of a metal sheet. The metal sheet has a thickness of, for example, 2.5 micrometers and may be provided by metal evaporation of, for example, a combination of aluminum and chromium. The output apertures 223,224,225 may have a circular shape with a diameter of, for example, 20 micrometers. Furthermore, each filament 202,203,204 for heating the cathodes 205,206,207 can be coupled to a first power supply V1 (not shown). In operation, each filament 202,203,204 heats a corresponding cathode 205,206,207. The cathode comprises conventional oxide cathode material, for example, barium oxide.

In operation, the first electrodes 226,227,228 are coupled to a second power supply VA1 for applying an electric field with a field strength E1 between the cathodes 205,206,207 and the output apertures 223,224,225. The voltage of the second power supply is, for example, in the range between 100 and 1500 V, typically 700 V. The secondary emission coefficient $\delta$ and the field strength have values which allow electron transport through the electron beam guidance cavity. This kind of electron transport is known from the cited U.S. Pat. No. 5,270,611.

According to the invention, an electron lens is formed by the first electrode 226 and the accelerating grid 140 between the output apertures 223,224,225 of each cavity 220,221,222 and the main lens 150 for reducing the diameter of the electron beam which enters the main lens. Preferably, the electron lens comprises a so-called cup lens, which is formed by the first electrodes 226,227,228. The cup lens comprises a first and a second part, which parts are situated behind each other along an axis of the main lens 150. The diameter of the first part of the cup lens is smaller than the diameter of the second part of the cup lens. Preferably, both parts are circularly symmetric. However, by applying non-circularly symmetric parts, for example, an ellipsoidal or rectangular shape, the cup lens can be made astigmatic to correct the spot shape on the phosphor screen even more.

For a further explanation of the operation of the cathode ray tube, reference is made to FIG. 1. After the electrons have left the output apertures 223,224,225 of the electron beam guidance cavities 220,221,222, the electron lens formed by the first electrodes 226,227,228 and the accelerating gauze 140 prefocuses the electron beam in the main lens 150. In this way, the diameter of the electron beam entering the main lens is reduced and can be optimized for a minimal spot size on the display screen. Via the main lens 150 and the deflection unit 160, the three electron beams corresponding to the red, green and blue signals are directed to the phosphor screen 170 in order to build the image represented by the red, green and blue signals. The cup lens may be formed by various shapes of the first electrode as for example shown in FIG. 3 and FIG. 4.

Figure 3:
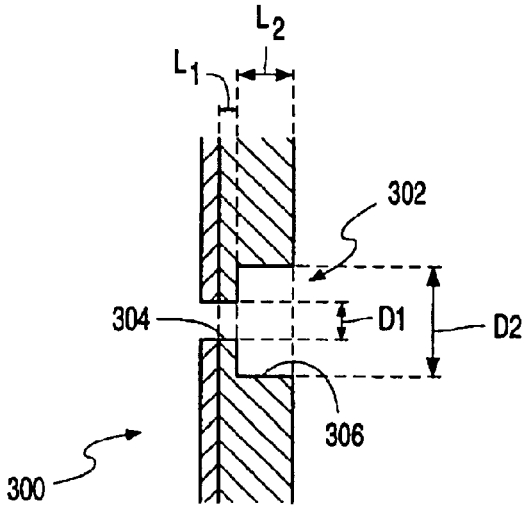
FIG. 3 shows a first example of a cup lens.

FIG. 3 is a cross-section of a first example in accordance with the invention, of a cup lens electrode 302 situated at the output aperture 300 of the cavity of the cathode structure. The electrode 302, situated at the wall 301 of the cavity, comprises a first part 304 and a second part 306, the first and second parts being placed behind each other along an axis of the main lens 150 (not shown). The first and second parts have, for example, a cylindrical shape. The first part 304 has a length L1 of, for example, 3 $\mu$m and a diameter D1 of 200 $\mu$m. The second part 306 has a length L2 of, for example, 250$\mu$ and a diameter D2 of, for example, 600 $\mu$m.

Figure 4:
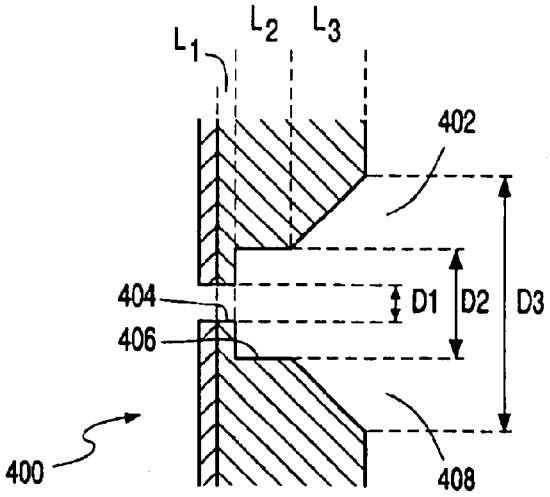
FIG. 4 shows a second example of a cup lens.

Rectangular and ellipsoidal shapes of the first and second parts are also possible. By adapting the shape of the first and second parts, the spot shape on the phosphor screen can be adapted. FIG. 4 is a cross-section of a second example of a cup lens electrode 402 which may be situated at the output apertures of the cathode structure according to the invention. The cup lens electrode 402 comprises three parts 404,406, 408 situated along a main axis of the main lens. Preferably, the first and second parts have a cylindrical shape and may have the same dimensions D1,L1 and D2,L2 as in the first cup lens electrode 302. Preferably, the third part has a frusto-conical shape. The side of the frusto-conical part 408 that has the largest diameter faces the main electron lens. The largest diameter D3 of the frusto-conical part of the cup lens electrode is, for example, 900 $\mu$m. The length L3 of the third part 408 is, for example 600 $\mu$m.

A second embodiment of the cathode ray tube according to the invention comprises an electron lens formed by the first electrode, a second electrode and the accelerating grid. The second electrode is concentric with the first electrode. Preferably, the first and second electrodes are in the same plane. An example of a planar electron lens formed by the first and second electrodes is shown in FIG. 5 and FIG. 6.

Figure 5:
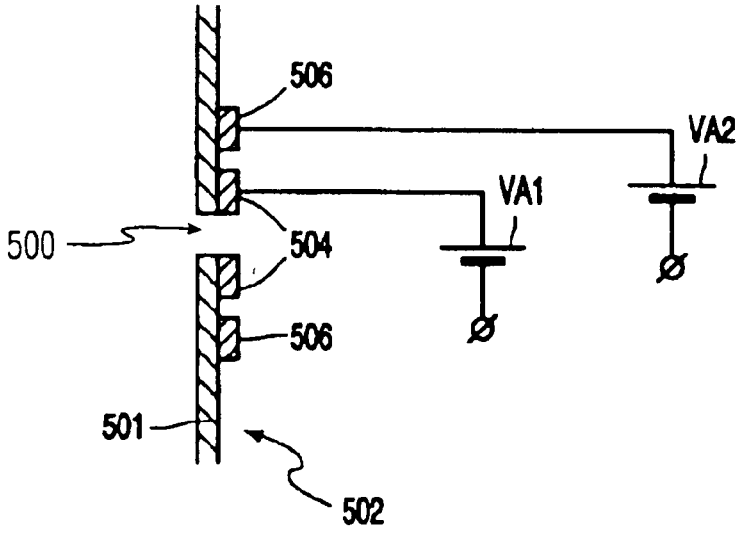
FIG. 5 is a cross-section of a planar electron lens.

FIG. 5 is a cross-section of a planar lens electrode which may be situated at the output aperture 500 of the cavity of the cathode structure. The planar electron lens electrode 502 comprises the first and second electrodes 504,506. Preferably, the first and second electrodes 504, 506 are concentric and circularly symmetric. Both electrodes 504, 506 can be made by providing a metal layer on the insulator and by etching the desired electrode patterns.

Figure 6:
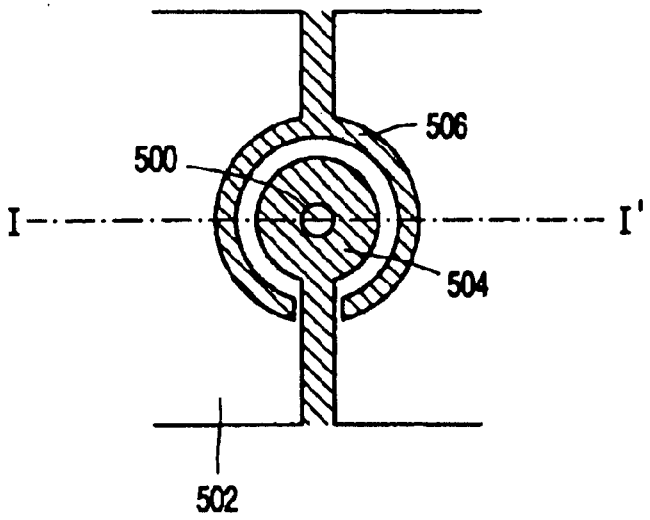
FIG. 6 is a top view of a planar electron lens.

FIG. 6 is a top view of the output aperture 500 and the first and second electrodes 504,506 of the planar electron lens electrode 502. Instead of a circularly symmetric shape of the first and second electrodes, a rectangular or ellipsoidal shape may also be applied. A further planar electrode may be applied for creating a further degree of freedom to manipulate the electron lens characteristics even more.

In operation, the first electrode 504 is connected to the second power supply VAI for applying an electric field with a field strength E1 allowing electron transport through the cavity. The second electrode 506 is connected to a third power supply VA2 for applying an electric field with a field strength E2 between the first and the second electrode 504,506. The voltage VA2 of the third power supply VA2 is determined in such a way that a desired rate of prefocusing is obtained for adapting the diameter of the electron beam entering the main lens. Furthermore, the voltage VA2 of the third power supply is lower than that of the second power supply VA1. For example, the voltage VA1 of the first power supply is 1000 V and the voltage VA2 of the second power supply is 600 V. Furthermore, the accelerating grid is connected to a fifth power supply (not shown) for applying an electric field having a sufficient field strength E3 for accelerating the electrons. The voltage VA3 is higher than that of the second power supply. For example, this voltage VA3 is 6000 Volts.

Preferably, third electrodes 230,231,232 are placed before the input apertures 208,209,210 between the cathodes 205, 206,207 and the cavities 220,221,222 for modulating the current of the electron beam. The third electrodes 230,231, 232 are coupled to a sixth power supply VA4 (not shown) for applying, in operation, an electric field with a fourth field strength E4 between the cathodes 205,206,207 and the third electrodes 230,231,232 for controlling the emission of electrons. Preferably, the third electrodes 230,231,232 comprise a gauze with a 60% transmission of electrons. The gauze can be made of a metal, for example molybdenum, and may be electrically coupled to the frame 201. In practice, the three gauzes 230,231,232 are electrically coupled to the frame 201. A voltage difference between the cathodes 205,206,207 and the gauzes 230,231,232 is determined by applying a fixed voltage to the frame and varying voltages to the gauzes. In operation, a pulling field due to the voltage difference applied between the gauzes 230,231,232 and the cathodes 205,206,207 pulls the electrons away from the cathodes 205,206,207. The voltage differences between the cathodes 205,206,207 and corresponding gauzes 230,231, 232 corresponds to the respective red, green and blue signals which represent the image.

Now, referring to cathode structure of FIG. 2, where the distance between the gauzes 230,231,232 and the cathodes 205,206,207 is small enough, for example, in a range between 20 and 400 micrometers, a relatively low voltage difference between the cathodes 205,206,207 and the gauzes 230,231,232 can modulate the emission of the electrons towards the input aperture of the electron beam guidance cavities 220,221,222. For example, when the distance between the cathodes 205,206,207 and the gauzes 230,231, 232 is 100 micrometers a voltage swing of 5 volts can modulate an electron current of between 0 and 3 mA to the electron beam guidance cavities 220,221,222.

It should be noted that the above-mentioned embodiments illustrate rather than limit the invention, and that those skilled in the art will be able to design many alternative solutions without departing from the scope of the claims.

What is claimed is:

1. A cathode ray tube, comprising:

an electron source including a cathode for an emission of electrons;

an electron beam guidance cavity including an input aperture and an output aperture for concentrating electrons emitted from said cathode;

a first electrode for applying a first electric field between said output aperture and said cathode to allow electron transport through said electron beam guidance cavity;

an accelerating grid for accelerating the electrons leaving said electron beam guidance cavity;

a first electron lens having an entrance for focusing the accelerated electrons onto a display screen;

wherein said first electrode and said accelerating grid collectively constitute a second electron lens between said electron beam guidance cavity and said first electron lens, said second electron lens for adapting a diameter of the accelerated electrons to a diameter of said entrance of said first electron lens; and wherein said first electrode includes a first part and a second part placed along an axis of said first electron lens.

2. The cathode ray tube of claim 1, wherein a diameter of said first part is smaller than a diameter of said second part.

3. The cathode ray tube of claim 1, wherein said first part and said second part both have a circularly symmetric shape.

4. The cathode ray tube of claim 1, wherein said first part and said second part both have a rectangular shape.

5. The cathode ray tube of claim 1, wherein said first part and said second part both have an ellipsoidal shape.

6. The cathode ray tube of claim 1, wherein said first electrode further includes a third part placed along the axis of said first electron lens.

7. The cathode ray tube of claim 6, wherein said third part has a frustoconical shape with a largest diameter of said third part facing said first electron lens.

8. The cathode ray tube of claim 1, further comprising:

a second electrode for applying a second electric field between said first electrode and said second electrode, wherein said first electrode, said second electrode and said accelerating grid collectively constitute said second electron lens between said electron beam guidance cavity and said first electron lens.

9. The cathode ray tube of claim 8, wherein said first electrode and said second electrode are concentric.

10. The cathode ray tube of claim 8, wherein said first electrode and said second electrode both have a circularly symmetric shape.

11. The cathode ray tube of claim 8, wherein said first electrode and said second electrode both have a rectangular shape.

12. The cathode ray tube of claim 8, wherein said first electrode and said second electrode both have an ellipsoidal shape.

13. The cathode ray tube of claim 8, further comprising:

a third electrode between said cathode and said electron beam guidance cavity, said third electrode for applying a third electric field between said cathode and said electron beam guidance cavity to control the emission of electrons.

14. A cathode ray tube, comprising:

an electron source including a cathode for an emission of electrons;

an electron beam guidance cavity including an input aperture and an output aperture for concentrating electrons emitted from said cathode;

a first electrode for applying a first electric field between said output aperture and said cathode to allow electron transport through said electron beam guidance cavity;

a second electrode for applying a second electric field between said first electrode and said second electrode, said first electrode and said second electrode being concentric;

an accelerating grid for accelerating the electrons leaving said electron beam guidance cavity;

a first electron lens having an entrance for focusing the accelerated electrons onto a display screen;

wherein said first electrode, said second electrode and said accelerating grid collectively constitute a second electron lens between said electron beam guidance cavity and said first electron lens, said second electron lens for adapting a diameter of the accelerated electrons to a diameter of said entrance of said first electron lens.

15. The cathode ray tube of claim 14, wherein said first electrode includes a first part and a second part placed along an axis of said first electron lens; and wherein a diameter of said first part is smaller than a diameter of said second part.

16. The cathode ray tube of claim 15, wherein said first electrode further includes a third part placed along the axis of said first electron lens; and wherein said third part has a frustoconical shape with a largest diameter of said third part facing said first electron lens.

17. The cathode ray tube of claim 14, wherein said first electrode includes a first part and a second part placed along an axis of said first electron lens; and wherein said first part and said second part both have a circularly symmetric shape.

18. The cathode ray tube of claim 17, wherein said first electrode further includes a third part placed along the axis of said first electron lens; and wherein said third part has a frustoconical shape with a largest diameter of said third part facing said first electron lens.

19. The cathode ray tube of claim 14, wherein said first electrode includes a first part and a second part placed along an axis of said first electron lens; and wherein said first part and said second part both have a rectangular shape.

20. The cathode ray tube of claim 19, wherein said first electrode further includes a third part placed along the axis of said first electron lens; and wherein said third part has a frustoconical shape with a largest diameter of said third part facing said first electron lens.

21. The cathode ray tube of claim 14, wherein said first electrode includes a first part and a second part placed along an axis of said first electron lens; and wherein said first part and said second part both have an ellipsoidal shape.

22. The cathode ray tube of claim 21, wherein said first electrode further includes a third part placed along the axis of said first electron lens; and wherein said third part has a frustoconical shape with a largest diameter of said third part facing said first electron lens.

23. The cathode ray tube of claim 14, wherein said first electrode and said second electrode both have a circularly symmetric shape.

24. The cathode ray tube of claim 14, wherein said first electrode and said second electrode both have a rectangular shape.

25. The cathode ray tube of claim 14, wherein said first electrode and said second electrode both have an ellipsoidal shape.

26. The cathode ray tube of claim 14, further comprising:

a third electrode between said cathode and said electron beam guidance cavity, said third electrode for applying a third electric field between said cathode and said electron beam guidance cavity to control the emission of electrons.

27. A cathode ray tube, comprising:

an electron source including a cathode for an emission of electrons;

an electron beam guidance cavity including an input aperture and an output aperture for concentrating electrons emitted from said cathode;

a first electrode for applying a first electric field between said cathode and said electron beam guidance cavity to control the emission of electrons;

a second electrode for applying a second electric field between said output aperture and said cathode to allow electron transport through said electron beam guidance cavity;

an accelerating grid for accelerating the electrons leaving said electron beam guidance cavity;

a first electron lens having an entrance for focusing the accelerated electrons onto a display screen;

wherein said second electrode and said accelerating grid collectively constitute a second electron lens between said electron beam guidance cavity and said first electron lens, said second electron lens for adapting a diameter of the accelerated electrons to a diameter of said entrance of said first electron lens.

28. The cathode ray tube of claim 27, wherein said second electrode includes a first part and a second part placed along an axis of said first electron lens; and wherein a diameter of said first part is smaller than a diameter of said second part.

29. The cathode ray tube of claim 28, wherein said second electrode further includes a third part placed along the axis of said first electron lens; and wherein said third part has a frustoconical shape with a largest diameter of said third part facing said first electron lens.

30. The cathode ray tube of claim 27, wherein said second electrode includes a first part and a second part placed along an axis of said first electron lens; and wherein said first part and said second part both have a circularly symmetric shape.

31. The cathode ray tube of claim 30, wherein said second electrode further includes a third part placed along the axis of said first electron lens; and wherein said third part has a frustoconical shape with a largest diameter of said third part facing said first electron lens.

32. The cathode ray tube of claim 27, wherein said second electrode includes a first part and a second part placed along an axis of said first electron lens; and wherein said first part and said second part both have a rectangular shape.

33. The cathode ray tube of claim 32, wherein said first electrode further includes a third part placed along the axis of said first electron lens; and wherein said third part has a frustoconical shape with a largest diameter of said third part facing said first electron lens.

34. The cathode ray tube of claim 27, wherein said second electrode includes a first part and a second part placed along an axis of said first electron lens; and wherein said first part and said second part both have an ellipsoidal shape.

35. The cathode ray tube of claim 34, wherein said second electrode further includes a third part placed along the axis of said first electron lens; and wherein said third part has a frustoconical shape with a largest diameter of said third part facing said first electron lens.

36. The cathode ray tube of claim 27, further comprising:

a third electrode for applying a second electric field between said second electrode and said third electrode, wherein said second electrode, said third electrode and said accelerating grid collectively constitute said second electron lens between said electron beam guidance cavity and said first electron lens.

37. The cathode ray tube of claim 36, wherein said second electrode and said third electrode both have a circularly symmetric shape.

38. The cathode ray tube of claim 36, wherein said second electrode and said third electrode both have a rectangular shape.

39. The cathode ray tube of claim 36, wherein said second electrode and said third electrode both have an ellipsoidal shape.

40. A cathode ray tube having a screen and comprising:

a. an electron source including a cavity structure for transporting electrons from a cathode toward an output opening of said cavity structure where said electrons are concentrated and emitted at a high velocity relative to the electron emission velocity from the cathode;

b. a first electrode disposed adjacent the output opening and responsive to an applied voltage for effecting transport of the electrons through the cavity structure and emission through the output opening as an electron beam;

c. a second electrode for accelerating the electron beam toward a main electron lens where said electron beam is focused onto the screen;

said first and second electrodes cooperating to form a further electron lens for effecting a reduction of the electron beam diameter at the main electron lens.

41. A cathode ray tube as in claim 40 where the first electrode comprises, arranged in the direction of propagation of the electron beam, a first part and a second part, each of said parts having a respective width and an opening for permitting passage of the electron beam, the width of the first part being smaller than the width of the second part.

42. A cathode ray tube as in claim 41 where the width of the aperture in the first part is smaller than the width of the aperture in the second part.

43. A cathode ray tube as in claim 40 where the first electrode comprises, arranged in the direction of propagation of the electron beam, a first part, a second part, and a third part, each of said parts having a respective width and an opening for permitting passage of the electron beam.

44. A cathode ray tube as in claim 43 where the aperture of the third part widens with distance from the output opening in the cavity structure.

45. A cathode ray tube as in claim 40 where the first electrode comprises a first part disposed around a path of the emitted electron beam and a second part disposed around the first part.

* * * * *